US010640327B2

(12) United States Patent
Salmikuukka

(10) Patent No.: US 10,640,327 B2
(45) Date of Patent: May 5, 2020

(54) ELEVATOR ARRANGEMENT PROVIDED WITH REMOTE ELEVATOR SYSTEM GROUP CONTROLLER, METHOD AND COMPUTER PROGRAM PRODUCT

(71) Applicant: KONE Corporation, Helsinki (FI)

(72) Inventor: Jukka Salmikuukka, Espoo (FI)

(73) Assignee: KONE CORPORATION, Helsinki (FI)

( * ) Notice: Subject to any disclaimer, the term of this patent is extended or adjusted under 35 U.S.C. 154(b) by 434 days.

(21) Appl. No.: 15/448,061

(22) Filed: Mar. 2, 2017

(65) Prior Publication Data

US 2017/0174470 A1 Jun. 22, 2017

Related U.S. Application Data

(63) Continuation of application No. PCT/FI2014/050747, filed on Oct. 1, 2014.

(51) Int. Cl.

| | |
|---|---|
| ***B66B 1/28*** | (2006.01) |
| ***B66B 1/34*** | (2006.01) |
| ***B66B 5/00*** | (2006.01) |
| ***B66B 1/24*** | (2006.01) |

(52) U.S. Cl.

CPC ..... *B66B 1/3415* (2013.01); *B66B 1/2458* (2013.01); *B66B 5/0018* (2013.01); *B66B 2201/00* (2013.01)

(58) Field of Classification Search

CPC ... B66B 1/3415; B66B 1/2458; B66B 5/0018; B66B 2201/00

USPC ..... 187/247, 380–389, 391–394

See application file for complete search history.

(56) References Cited

U.S. PATENT DOCUMENTS

| | | | | |
|---|---|---|---|---|
| 4,046,227 | A * | 9/1977 | Kirsch | B66B 1/2458 187/387 |
| 4,111,284 | A * | 9/1978 | Winkler | B66B 1/18 187/380 |
| 4,114,730 | A * | 9/1978 | Means | B66B 1/18 187/247 |
| 4,397,377 | A * | 8/1983 | Husson | B66B 5/0006 187/382 |
| 4,511,017 | A * | 4/1985 | MacDonald | B66B 5/02 187/383 |
| 4,568,909 | A * | 2/1986 | Whynacht | B66B 5/0006 187/393 |
| 4,765,442 | A * | 8/1988 | Blain | B66B 1/2433 187/247 |

(Continued)

FOREIGN PATENT DOCUMENTS

JP 2001-158578 A 6/2001

OTHER PUBLICATIONS

Extended European Search Report for Application No. 14903069.4, dated May 15, 2018.

*Primary Examiner* — Anthony J Salata

(74) *Attorney, Agent, or Firm* — Birch, Stewart, Kolasch & Birch, LLP

(57) ABSTRACT

An elevator arrangement includes an elevator group. A connection to a remote elevator system group controller is monitored. Traffic is served by the elevator group as controlled by a local elevator system group controller, when the connection is down. Traffic is served by the elevator group as controlled by the remote elevator system group controller, when the connection is up.

19 Claims, 2 Drawing Sheets

(56) References Cited

U.S. PATENT DOCUMENTS

| | | | | |
|---|---|---|---|---|
| 4,766,978 | A * | 8/1988 | Blain | B66B 1/343 187/247 |
| 4,771,865 | A * | 9/1988 | Hinderling | B66B 5/0006 187/391 |
| 4,947,965 | A * | 8/1990 | Kuzunuki | B66B 1/18 187/383 |
| 5,307,903 | A * | 5/1994 | Morita | B66B 1/18 187/380 |
| 5,398,782 | A * | 3/1995 | Talbot | B66B 5/0006 187/247 |
| 5,892,190 | A | 4/1999 | Morita et al. | |
| 6,269,911 | B1 | 8/2001 | Richter | |
| 9,108,824 | B2 * | 8/2015 | Hughes | B66B 1/34 |
| 2002/0112923 | A1 | 8/2002 | Nakai | |
| 2004/0094366 | A1 | 5/2004 | Weinberger et al. | |

* cited by examiner

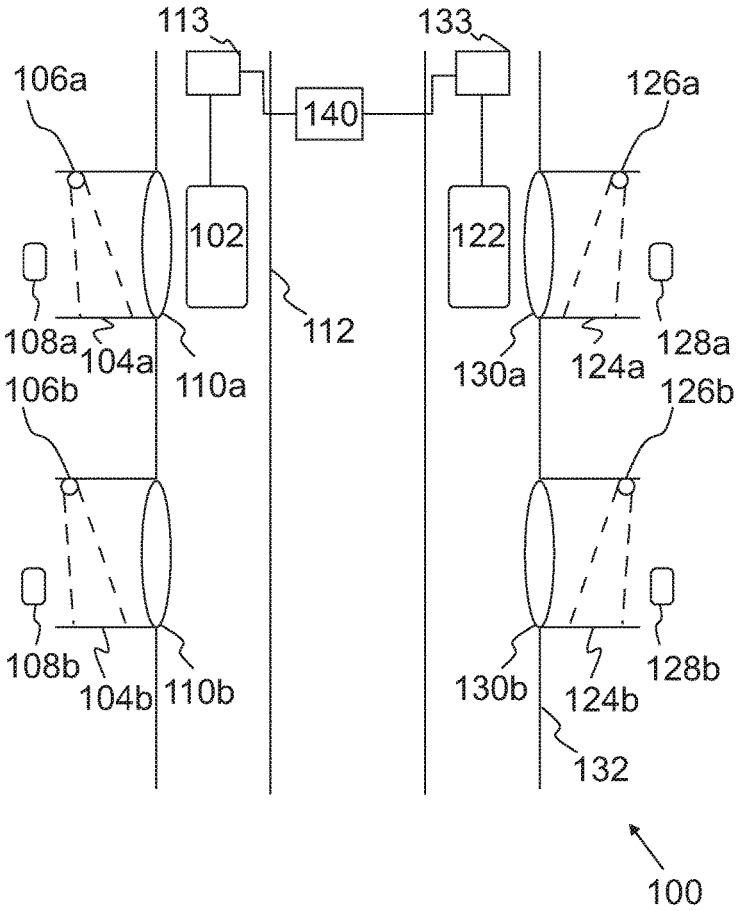

100: elevator arrangement
102, 122: elevator car
104a, 104b, 124a, 124b: landing zone
106a, 106b, 126a, 126b: sensor
108a, 108b, 128a, 128b: operating panel
110a, 110b, 130a, 130b: doorway
112, 132: hoistway
113, 133: hoisting machinery
140: local elevator system group controller

Figure 1

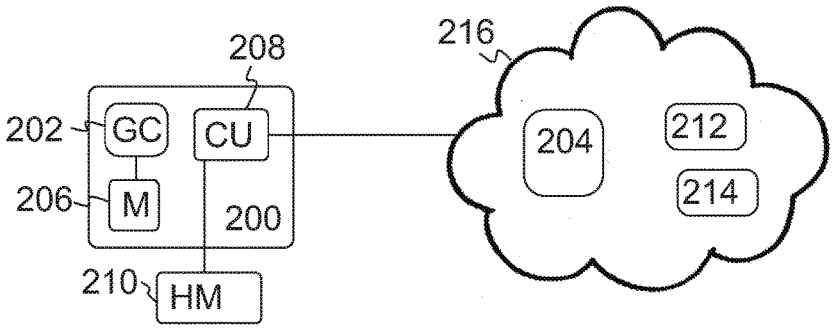

200: elevator arrangement
202: local elevator system group controller
204: remote elevator system group controller
206: memory
208: communications unit
210: hoisting machinery
212, 214: external data source
216: external network

Figure 2

ELEVATOR ARRANGEMENT PROVIDED WITH REMOTE ELEVATOR SYSTEM GROUP CONTROLLER, METHOD AND COMPUTER PROGRAM PRODUCT

CROSS REFERENCE TO RELATED APPLICATIONS

This application is a Continuation of PCT International Application No. PCT/FI2014/050747, filed on Oct. 1, 2014, the entire content of which is herein expressly incorporated by reference into the present application.

FIELD

The invention relates to an elevator arrangement and particularly to elevator system group controllers for an elevator arrangement.

BACKGROUND

Optimization of people flows in large building is traditionally done in elevator system group controllers. The elevator system group controllers optimize service and capacity of an elevator group in transporting people. As the buildings grow, elevator groups grow and several groups and even horizontal people flows needs to be managed simultaneously. Therefore, in large elevator groups an amount of data to be processed by the elevator system group controller is also large.

The large amount of data means that the challenge of optimizing the people flow becomes complex and the demand for computing power is high for solving the optimization task in an acceptable time.

On the other hand, the complexity of the optimization task may vary in time, for example the time of day, whereby the demand for computing power may have peaks. In order to satisfy the demand for computing power, the physical resources in the elevator system group controller should be increased. However, this causes the elevator system group controller to take more space in the building the elevator group is deployed. In addition to the building having sufficient space for the elevator system group controller, the space should also be air-conditioned to keep the temperature within an operational range of the elevator system group controller.

BRIEF DESCRIPTION OF SOME EMBODIMENTS

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

According to an aspect, there is provided the subject matter of the independent claims. Embodiments are defined in the dependent claims.

One or more examples of implementations are set forth in more detail in the accompanying drawings and the description below. Other features will be apparent from the description and drawings, and from the claims.

Some embodiments provide improvements comprising controlling an elevator group by a remote elevator system group controller.

Some embodiments provide improvements to controlling an elevator group, when a connection to a remote elevator system group controller is down.

Some embodiments provide improvements to adapting computing power dedicated to optimization of traffic flow.

BRIEF DESCRIPTION OF THE DRAWINGS

In the following the invention will be described in greater detail by means of preferred embodiments with reference to the accompanying drawings, in which FIG. 1 illustrates an elevator arrangement according to an embodiment;

FIG. 2 illustrates architecture of an elevator arrangement comprising a local elevator system group controller and a remote elevator system group controller, according to an embodiment;

DETAILED DESCRIPTION

Figure 3:
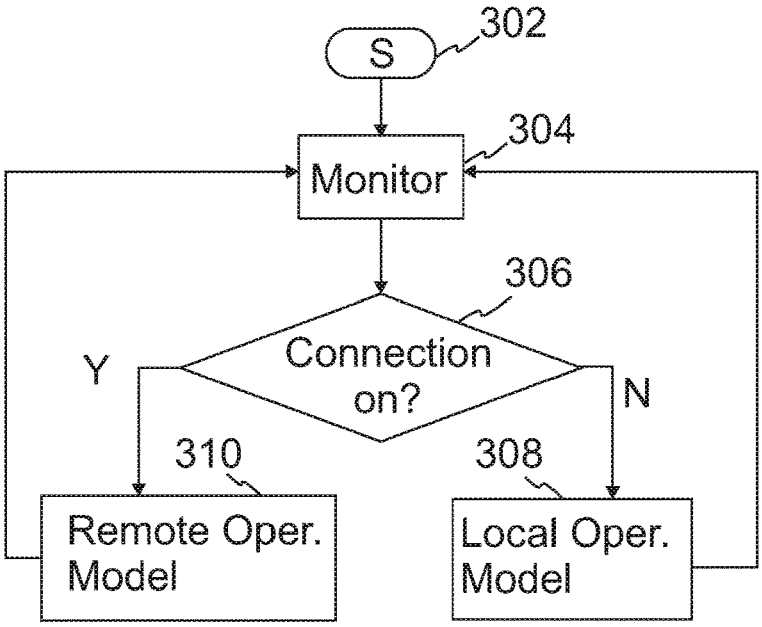
FIG. 3 illustrates a method according to an embodiment.

FIG. 1 illustrates an elevator arrangement 100 according to an embodiment. The elevator arrangement comprises an elevator group that includes a plurality of elevator cars 102, 122 movable between landing zones 104*a*, 104*b*, 124*a*, 124*b* that communicate traffic, e.g. people, to and from the elevator cars through doorways 110*a*, 110*b*, 130*a*, 130*b*. The elevator cars are supported by ropes in hoistways 112, 132 such that the elevator cars may be moved up or down the hoistways by hoisting machineries 113, 133 connected to the ropes. The hoistways may be located in a single shaft or separate shafts. In the illustration the elevator cars are located in separate shafts.

Sensors 106*a*, 106*b*, 108*a*, 108*b*, 126*a*, 126*b* may be installed to the elevator arrangement for obtaining data on traffic and environment of the elevator arrangement. The sensors may be installed to the elevator cars, hoistways, doorways and landing zone for example. In FIG. 1, the sensors 106*a*, 106*b*, 126*a*, 126*b* are installed to ceilings in the landing zones to monitor traffic that enters the elevator car, leaves the elevator car or is waiting in the landing zone for arrival of the elevator car. Examples of sensors comprise optical sensors, radio frequency sensors, cameras and weight sensors. Operating panels 108*a*, 108*b*, 128*a*, 128*b* on the landing zones or in inside elevator cars (not shown) may also serve as sensors.

The operating panel may include a user interface, for example one of buttons, a touch screen and/or a display. The operating panel provides a user to enter a destination landing zone to the elevator arrangement.

The sensors may be connected to a Local Elevator System Group Controller (LESGC) 140 such that data from the sensors, for example destination landing zone may be used for traffic flow optimization in the elevator group. The connections between the sensors and the LESGC may be wired or wireless connections. Wireless connections may be implemented using devices capable of operating according to a Wireless Local Area Network standard defined by the IEEE 802.11 family of standards. Wired connections may be implemented by wiring, for example field buses and Ethernet connections. Both the wireless and wireless communications may be based on the Internet Protocol.

The elevator car may be driven between the floors on the basis of the destination landing zone received via the operating panel. The elevator arrangement may comprise more than one operating panels that each may be used to enter a destination landing zone. The landing zone may have an operating panel installed to a wall. A typical operating panel in the landing zone is a button for indicating a destination landing zone that is higher or lower than the landing zone of the operating panel. Both operating panels in the landing zone and the in the elevator car may be capable of receiving a specific destination landing zone, e.g. defined by a number of the floor the landing zone is located in.

The LESGC may perform traffic flow optimization in the elevator group on the basis of data from sensors in the elevator arrangement. The traffic flow optimization may comprise inputting the data from the sensors to a local operating model to determine actions in the elevator arrangement for traffic flow optimization. The actions in the elevator arrangement comprise controlling movement of the elevator cars between the landing zones. The LESGC may be connected to the hoisting machineries for issuing control commands to the hoisting machineries for driving the elevator cars between the landing zones.

A LESGC may be connected to hoisting machinery over a secure connection. The security of the connection may be provided by a short distance and/or a dedicated communication path for the communications between the LESGC and the hoisting machinery. In this way the number of intermediate devices such as hosts, bridges and routers may be kept low.

A landing zone may be located in one floor in a building where the elevator arrangement is installed. The landing zone refers to an area of the floor that communicates traffic with the elevator car through the doorway. The doorway may comprise a door such that the doorway may be closed, when the elevator car is not at the landing zone, but for example moving between the floors or stopped to another floor.

FIG. 2 illustrates an elevator arrangement 200 controllable by a local elevator system group controller 202 and a Remote Elevator System Group Controller 204 (RESGC), according to an embodiment. The LESGC may be installed to the elevator arrangement described in FIG. 1. The LESGC may be connected electrically to a memory (M) 206 and a Communications Unit (CU) 208 such that functionalities according to an embodiment may be caused.

In an example of implementation of the elevator arrangement, the LESGC, M and CU may be for example installed to the same instrument cabin, where they are connected by a communication bus within the instrument cabin.

The CU provides transmission and reception of information between the elevator arrangement and the RESGC, and between the LESGC and the units of the elevator arrangement, for example one or more hoisting machineries (HMs) 210 and sensors. The connection to the RESGC may be an Internet Protocol connection over Ethernet connection. The RESGC may be located in an external network 216, for example the Internet. Connecting RESGC to the elevator arrangement provides that the elevator group in the elevator arrangement may be controller by the RESGC.

The RESGC may be connected to one or more external data sources 212, 214 that provide information for traffic flow optimization in the elevator arrangement. Examples of the information provided by the external data sources comprise public transportation schedules, real-time data from traffic on the streets, real-time data form traffic on the roads, real-time data from the public transportation. The RESGC may be connected to the data sources over IP connections for example in the Internet. The external data source may comprise for example databases that may be accessed by the RESGC.

In an embodiment the RESGC is implemented in a cloud computing system. In the cloud computing system, the functionality of the RESGC may be executed by a plurality of computers in the cloud computing system. The cloud computing system provides adapting computing power dedicated to optimization of traffic flow. Accordingly resources may be flexibly allocated to the RESGC based on the complexity of traffic flow optimization tasks at hand, which may depend on an amount of traffic or on distribution of traffic to name a few.

FIG. 3 illustrates a method according to an embodiment. The method may be performed in an elevator arrangement of FIG. 2. A LESGC or another control entity in the elevator arrangement may cause execution of the method steps.

The method may start 302, when the elevator arrangement is deployed and operational. The connections illustrated in FIG. 2 are configured and functional, thus data may be communicated over the connections.

In 304, the connection between the elevator arrangement and the RESGC may be monitored. Monitoring of the connection facilitates determining when the RESGC can control the elevator group and when the RESGC cannot control the elevator group. The RESGC may control the elevator group when data from the sensors of the elevator arrangement can be received by the RESGC and the RESGC can send control commands and/or a new local operating model to the elevator arrangement.

The monitoring may comprise monitoring an amount of traffic, size of data packets and/or type of data packets for example. The monitoring may be used to determine an amount of traffic in one direction or in both directions between the elevator arrangement and the RESGC. If the amount of traffic in either or both directions is below a threshold, it may be determined that the connection may be down. Polling messages, for example ping messages, may be sent in one or both directions to determine whether the connection is down.

The size of data packets may be monitored to determine whether the connection between the elevator arrangement and the RESGC is down or up. When the size of data packets correspond to a size of data packets that are typical for error messages, it may be determined that the connection towards the sender of the data packets is down.

In the monitoring, the type of data packets may be identified as error messages or negative acknowledgement messages, whereby the connection towards the originator of such messages may be determined as being down.

If 306 the connection between the elevator arrangement and the RESGC is down in one or both directions, the method proceeds to 308, where traffic may be served by the elevator cars on the basis of the local operating model. The connection may be down, when traffic cannot be communicated in one or both directions on the connection. The connection may be down due to a broken device, cable or wire or due to a restart of a device that forms a part of the connection.

In an embodiment the local operating model may be formed on the basis of data from the sensors within the elevator arrangement. The data may be input to the local elevator system group controller for forming the local operating model. The LESGC may be used by the LESGC for serving traffic when the connection to the RGC is down.

In an embodiment the local operating model used by the LESGC for serving traffic when the connection to the RGC is down may be obtained from the RESGC when the connection to the RESGC is up, i.e. prior to the connection being down.

If 306 the connection between the elevator arrangement and the RESGC is up, traffic may be served 310 by the elevator cars as controlled by the RESGC, when the connection is up. A connection may be up, when traffic may be communicated in both directions on the connection. The RESGC may control the elevator cars on the basis of a remote operating model. The controlling may comprise sending control commands to the elevator arrangement. The elevator control commands may be direct commands to drive the elevator car or the control commands may be a drive profile file that includes parameters for driving the elevator cars.

When the connection is up, data from the sensors of the elevator arrangement can be received by the RESGC and used to update the remote operating model.

After the status of the connection is determined as up or down, traffic may be served 308, 310 according to the remote operating mode or the local operating model and monitoring 304 of the connection may be continued.

In an embodiment the RESGC may obtain data from the sensors in the elevator arrangement and the external data sources, when the connection between the RESGC and the elevator arrangement is up. The obtained data are input to the RESGC that may process the data and form a remote operating model. The remote operating model may be updated on the basis of the data form the sensors as well as data form the external data sources. The RESGC may combine the data from the elevator arrangement and external data sources for updating the remote operating model. The remote operating model may be used to determine control commands to the elevator arrangement for controlling the elevator group, e.g. driving the elevator cars.

In an embodiment, the local operating model may be updated on the basis of the remote operating model. The RESGC may form a new local operating model on the basis of the remote operating model. The new local operating model may be communicated to the elevator arrangement. In this way the elevator arrangement may use an operating model that is formed on the basis of data sources from the elevator arrangement as well as external data sources even if connection to the remote elevator arrangement is down. The local operating model may require less computational power than the remote operating model. The local operating model may have less parameters than the remote operating model. Since the local operating model is formed on the basis of data sources that are internal to the elevator arrangement as well as external data sources, the local operating model may be optimized for the elevator arrangement such that traffic in the elevator arrangement may be served efficiently even if the connection to the RESGC is down.

Figure 4:
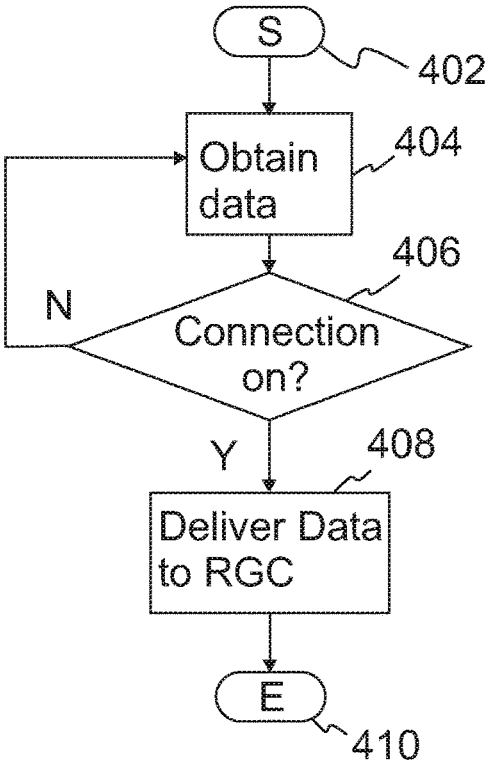
FIG. 4 illustrates operation on re-establishment of connection to a remote elevator system group controller.

FIG. 4 illustrates operation on re-establishment of connection to a RESGC. The operation may be performed in an elevator arrangement of FIG. 1, for example by the LESGC. The re-establishment of connection to the RESGC may start 402 after it has been determined that a connection to the RESGC is down, for example in step 308 in FIG. 3.

In 404, data from sensors in the elevator arrangement may be obtained. The data may be buffered for later use. In one of embodiments according to the present invention, the data may be buffered when the connection to the remote elevator system group controller is down.

If 406 the connecting is up, the buffered data may be sent 408 to the RESGC. The buffered data may be used to update the remote operating model and/or to determine a new local operating model. The connection may be determined to be up on the basis of monitoring the connection as described in step 304 in FIG. 3.

If 406 the connection is not up, the buffering of data may be continued and the method proceeds to 402. The connection may be determined to be down on the basis of monitoring the connection as described in step 304 in FIG. 3.

In 410 the method ends after connection to the RESGC is re-established and the connection is up.

Implementations of an elevator arrangement, a RESGC or a LESGC according to embodiments may comprise a central processing unit (CPU). The CPU may comprise a set of registers, an arithmetic logic unit, and a control unit. The control unit is controlled by a sequence of program instructions transferred to the CPU from the memory. The control unit may contain a number of microinstructions for basic operations. The implementation of microinstructions may vary, depending on the CPU design. The program instructions may be coded by a programming language, which may be a high-level programming language, such as C, Java, etc., or a low-level programming language, such as a machine language, or an assembler. The memory may be a volatile or a non-volatile memory, for example EEPROM, ROM, PROM, RAM, DRAM, SRAM, firmware, programmable logic, etc. The memory and the controller may be connected by an electrical connection provided e.g. by a printed circuit board, where the memory and the controller are installed.

In various embodiments, the LESGC and the RESGC may include or be connected to a memory that may store an operating model to be used in controlling an elevator group.

An embodiment provides a computer program embodied on a distribution medium, for example a non-transitory computer readable storage medium, comprising program instructions which, when loaded into an electronic apparatus, cause the controller to perform a method according to an embodiment.

The computer program may be in source code form, object code form, or in some intermediate form, and it may be stored in some sort of carrier, which may be any entity or device capable of carrying the program. Such carriers include a record medium, computer memory, read-only memory, electrical carrier signal, telecommunications signal, and software distribution package, for example. Depending on the processing power needed, the computer program may be executed in a single electronic digital computer or processor or it may be distributed amongst a number of computers or processors.

Execution of the computer program or a computer program product for a computer, comprising software code portions, causes execution of a method according to an embodiment.

The techniques described herein may be implemented by various means so that an elevator arrangement implementing one or more functions described with an embodiment comprises not only prior art means, but also means for monitoring a connection to the RESGC, and serving traffic by the elevator cars on the basis of the local operating model, when the connection is down, and serving traffic by the elevator cars as controlled by the RESGC, when the connection is up.

More precisely, the various means comprise means for implementing functionality of a corresponding elevator arrangement described with an embodiment and it may comprise separate means for each separate function, or means may be configured to perform two or more functions. For example, these techniques may be implemented in hardware (one or more apparatuses), firmware (one or more apparatuses), software (one or more modules), or combinations thereof. For a firmware or software, implementation can be through modules (e.g., procedures, functions, and so on) that perform the functions described herein. The software codes may be stored in any suitable, processor/computer-readable data storage medium(s) or memory unit(s) or article(s) of manufacture and executed by one or more processors/computers. The data storage medium or the memory unit may be implemented within the processor/computer or external to the processor/computer, in which case it can be communicatively coupled to the processor/computer via various means as is known in the art.

It will be obvious to a person skilled in the art that, as the technology advances, the inventive concept can be implemented in various ways. The invention and its embodiments are not limited to the examples described above but may vary within the scope of the claims.

The invention claimed is:

1. An elevator arrangement comprising:

an elevator group; and a local elevator system group controller for serving traffic on the basis of a local operating model and a communications unit for connecting the elevator arrangement to a remote elevator system group controller, wherein the remote elevator system group controller is provided remotely from the elevator group and is located in an external network, wherein the local elevator system group controller is connected to the elevator group and communications unit to cause:

monitoring a connection to the remote elevator system group controller;

serving traffic by the elevator group as controlled by the local elevator system group controller, when the connection is down; and serving traffic by the elevator group as controlled by the remote elevator system group controller, when the connection is up.

2. The elevator arrangement according to claim 1, wherein the remote elevator system group controller controls the elevator group on the basis of a remote operating model.

3. The elevator arrangement according to claim 1, wherein the remote elevator system group controller comprises a cloud computing system.

4. The elevator arrangement according to claim 2, wherein the elevator arrangement comprises sensors for obtaining data on traffic and environment of the elevator arrangement and the data from the sensors and data from external data sources from the elevator arrangement are input to the remote operating model for serving traffic as controlled by the remote operating model.

5. The elevator arrangement according to claim 4, wherein data from the sensors within the elevator arrangement is input to the local operating model for serving traffic as controlled by the local operating model.

6. The elevator arrangement according to claim 2, wherein a new local operating model is formed on the basis of the remote operating model.

7. The elevator arrangement according to claim 1, wherein the elevator arrangement comprises sensors for obtaining data on traffic and environment of the elevator arrangement, and the data is buffered when the connection to the remote elevator system group controller is down and the buffered data is sent to the remote elevator system group controller when the connection is up for forming a new local operating model or updating the remote operating model.

8. A method for an elevator arrangement comprising an elevator group, comprising the steps of:

monitoring a connection to a remote elevator system group controller;

serving traffic by the elevator group as controlled by a local elevator system group controller, when the connection is down; and serving traffic by the elevator group as controlled by the remote elevator system group controller, when the connection is up.

9. A computer program product for a computer embodied on a non-transitory computer readable medium, comprising software code portions that when run on a computer causes execution of a method comprising the steps of:

monitoring a connection to a remote elevator system group controller;

serving traffic by the elevator group as controlled by a local elevator system group controller, when the connection is down; and serving traffic by the elevator group as controlled by the remote elevator system group controller, when the connection is up.

10. The elevator arrangement according to claim 2, wherein the remote elevator system group controller comprises a cloud computing system.

11. The elevator arrangement according to claim 2, wherein the elevator arrangement comprises sensors for obtaining data on traffic and environment of the elevator arrangement and the data from the sensors and data from external data sources from the elevator arrangement are input to the remote operating model for serving traffic as controlled by the remote operating model.

12. The elevator arrangement according to claim 3, wherein the elevator arrangement comprises sensors for obtaining data on traffic and environment of the elevator arrangement and the data from the sensors and data from external data sources from the elevator arrangement are input to the remote operating model for serving traffic as controlled by the remote operating model.

13. The elevator arrangement according to claim 10, wherein a new local operating model is formed on the basis of the remote operating model.

14. The elevator arrangement according to claim 11, wherein a new local operating model is formed on the basis of the remote operating model.

15. The elevator arrangement according to claim 2, wherein the elevator arrangement comprises sensors for obtaining data on traffic and environment of the elevator arrangement, and the data is buffered when the connection to the remote elevator system group controller is down and the buffered data is sent to the remote elevator system group controller when the connection is up for forming a new local operating model or updating the remote operating model.

16. The elevator arrangement according to claim 3, wherein the elevator arrangement comprises sensors for obtaining data on traffic and environment of the elevator arrangement, and the data is buffered when the connection to the remote elevator system group controller is down and the buffered data is sent to the remote elevator system group controller when the connection is up for forming a new local operating model or updating the remote operating model.

17. The elevator arrangement according to claim 4, wherein the elevator arrangement comprises sensors for obtaining data on traffic and environment of the elevator arrangement, and the data is buffered when the connection to the remote elevator system group controller is down and the buffered data is sent to the remote elevator system group controller when the connection is up for forming a new local operating model or updating the remote operating model.

18. The elevator arrangement according to claim 5, wherein the elevator arrangement comprises sensors for obtaining data on traffic and environment of the elevator arrangement, and the data is buffered when the connection to the remote elevator system group controller is down and the buffered data is sent to the remote elevator system group controller when the connection is up for forming a new local operating model or updating the remote operating model.

19. The elevator arrangement according to claim 6, wherein the elevator arrangement comprises sensors for obtaining data on traffic and environment of the elevator arrangement, and the data is buffered when the connection to the remote elevator system group controller is down and the buffered data is sent to the remote elevator system group controller when the connection is up for forming a new local operating model or updating the remote operating model.

* * * * *